US006834723B2

(12) United States Patent
Jordan

(10) Patent No.: US 6,834,723 B2
(45) Date of Patent: Dec. 28, 2004

(54) SYSTEM AND METHOD FOR RISER RECOIL CONTROL

(75) Inventor: Larry Russell Jordan, Houston, TX (US)

(73) Assignee: Cooper Cameron Corporation, Houston, TX (US)

( * ) Notice: Subject to any disclaimer, the term of this patent is extended or adjusted under 35 U.S.C. 154(b) by 64 days.

(21) Appl. No.: 10/258,512

(22) PCT Filed: Apr. 27, 2001

(86) PCT No.: PCT/US01/13800

§ 371 (c)(1),
(2), (4) Date: Oct. 24, 2002

(87) PCT Pub. No.: WO01/81164

PCT Pub. Date: Nov. 1, 2001

(65) Prior Publication Data

US 2003/0205382 A1 Nov. 6, 2003

Related U.S. Application Data

(60) Provisional application No. 60/200,398, filed on Apr. 27, 2000.

(51) Int. Cl.[7] ..... E21B 19/09

(52) U.S. Cl. ..... 166/355; 114/264; 166/367; 175/5

(58) Field of Search ..... 175/5, 7; 166/355, 166/354, 367; 114/264; 405/224.1, 224.2, 224.3, 224.4, 195.1

(56) References Cited

U.S. PATENT DOCUMENTS

| | | | | |
|---|---|---|---|---|
| 4,351,261 A | | 9/1982 | Shanks | 114/264 |
| 4,487,150 A | * | 12/1984 | Shanks | 114/264 |
| 5,846,028 A | | 12/1998 | Thory | 405/195.1 |
| 5,978,739 A | | 11/1999 | Stockton | 702/6 |

* cited by examiner

*Primary Examiner*—William Neuder
(74) *Attorney, Agent, or Firm*—Michael P. Hartman; Peter J. Bielinski

(57) ABSTRACT

A riser recoil control system (10) adjusts tension forces (F1, F2) applied to a marine riser (60), which is attached to an anchored, floating vessel (30) and a wellhead (80). The riser (60) is attached to the vessel (30) using tension forces (F1, F2) asserted by riser tensioners (20). Each tensioner (20) has an air shutoff valve (110), and an orifice-controlled fluid valve (120). A disconnection sensing means (200) provides a disconnect signal when the riser (60) is disconnected from the wellhead (80), which closes the valves (110, 120) and adjusts the tension forces (F1, F2) applied by the tensioners (20). The invention includes a method for adjusting the tension forces (F1, F2) applied to the riser (60), including sensing the disconnect signal and adjusting the tension forces (F1, F2) supplied to the riser (60) by closing the air shutoff valves (110) and partially closing the orifice-controlled fluid valves (120).

12 Claims, 3 Drawing Sheets

SYSTEM AND METHOD FOR RISER RECOIL CONTROL

This application is a 371 of PCT/US01/13800 filed Apr. 27, 2001 which claims the benefit under Title 35 of the United States Code § 119(e) of U.S. Provisional Patent Application No. 60/200,398, filed Apr. 27, 2000.

TECHNICAL FIELD

This invention relates generally to a system and method for providing a motion-compensated drilling rig platform. More particularly, the invention relates to a system and method which can be used to control marine riser disconnection events in conjunction with such a platform.

HISTORY OF RELATED ART

Drilling operations conducted from a floating vessel require a flexible tensioning system which operates to secure the riser conductor between the ocean floor (at the well head) and the rig, or vessel. The tensioning system acts to reduce or eliminate the affects of vessel heave with respect to the riser, and to mitigate the effects of planned riser disconnect operations, and unexpected breaks or faults in the riser (hereinafter a "disconnect event").

Riser tensioner devices, which form the heart of the tensioning system, have been designed to assist in the management of riser conductors attached to drilling rigs, especially with respect to movement caused by periodic vessel heave. A series of these tensioners, connected to the riser by corresponding cables and sheaves, react to relative movement between the ocean floor and the vessel by adjusting the cable length to maintain a relatively constant tension on the riser. Any number of tensioners, typically deployed in pairs, may be used to suspend a single riser from the vessel.

Unexpected events may occur during offshore drilling operations. These may occur in the form of tensioner wireline breaks, severe storms, or other circumstances which require the vessel/rig operator to act quickly to adjust the tension applied to the riser. The riser may also become disconnected from the wellhead for various reasons.

The need to rapidly disconnect the riser as a planned operation, or the need to respond to an unexpected riser disconnect event, and manage the recoil tension or "slingshot" effect on the vessel induced thereby provides the motivation to develop a system and method to control the movement of the disconnected riser under tension. The system and method should operate by managing the tension applied to the riser using cabling attached to the riser and a plurality of riser tensioners. The system and method should also operate in response to sensing a disconnect event (typically provided by a Lower Marine Riser Package (LMRP) sensor), or in response to a discrete, operator-supplied, command which prepares the system to anticipate a riser disconnect. Thus, the system and method should be simple, robust, and provide an intermediate level of operation (i.e. "armed and ready to sense/manage a riser disconnect event"), such that system elements are demonstrated to be properly connected, and yet, not actively managing a disconnect event.

SUMMARY OF THE INVENTION

In one embodiment, the riser recoil control system of the present invention adjusts a series of tension forces applied to a marine riser, which is in turn typically attached to an anchored, floating vessel. The riser can be connected to, and disconnected from, a wellhead, and is attached to the vessel using tension forces exerted by a plurality of riser tensioners connected to the riser with cables and sheaves, and mounted to the vessel. Each tensioner has an air shutoff valve, and an orifice-controlled fluid valve set to a preselected flow limit value. The tensioners may also include a fluid volume speed control valve which acts to limit the volumetric rate of fluid flow in the tensioner whenever the flow rate exceeds a predetermined, critical, volumetric rate of flow.

The system also includes a disconnection sensing means, such as a switch (e.g., a LMRP sensor), which provides a disconnect signal when the riser is disconnected from the wellhead. Application of the disconnect signal to the air shutoff valves and orifice-controlled fluid valves results in closing the valves and adjusting the tension forces applied to the marine riser by the tensioners so as to limit the rate of travel experienced by the tensioner pistons as the tension force on the riser is reduced over the course of a managed disconnect event. While the air shutoff valve is typically set to close completely upon sensing a disconnect event, the orifice-controlled fluid valve is typically set to close down to about 15% of the maximum value after disconnect.

The system may include a first timer which delays closure of the air shutoff valves, and a second timer which delays closure of the orifice-controlled fluid valves, after the disconnect signal is applied. The delay times may be selected to manage the "slingshot" effect of the disconnected riser upon the vessel.

The system may also include a manual arming means, such as an emergency disconnect switch on the BOP (Blowout Preventer) Control Panel, adapted to provide an arming signal upon activation by a human operator. This action alerts the system to anticipate and act upon a disconnect signal from the BOP stack plates as they separate (i.e., from the LMRP sensor). The received disconnect signal then triggers operation of the system in a similar fashion to that described above.

The invention also includes a method for adjusting the tension forces applied to the riser. Assuming the existence of a riser recoil control system constructed in a similar fashion to that just described, the method may comprise the steps of sensing the disconnect signal provided by the disconnection sensing means and adjusting the tension force applied to the riser by closing the plurality of air shutoff valves, and partially closing the orifice-controlled fluid valves so as to move them from a first "pre-disconnect" preselected value (of about 50% of maximum free-flow rate permitted by the valve) to a second "post-disconnect" preselected flow rate value (preferably about 15% of the maximum free-flow rate value).

BRIEF DESCRIPTION OF THE DRAWINGS

A more complete understanding of the structure and operation of the present invention may be had by reference to the following detailed description taken in conjunction with the accompanying drawings, wherein.

DETAILED DESCRIPTION OF PRESENTLY PREFERRED EXEMPLARY EMBODIMENTS

Figure 1:
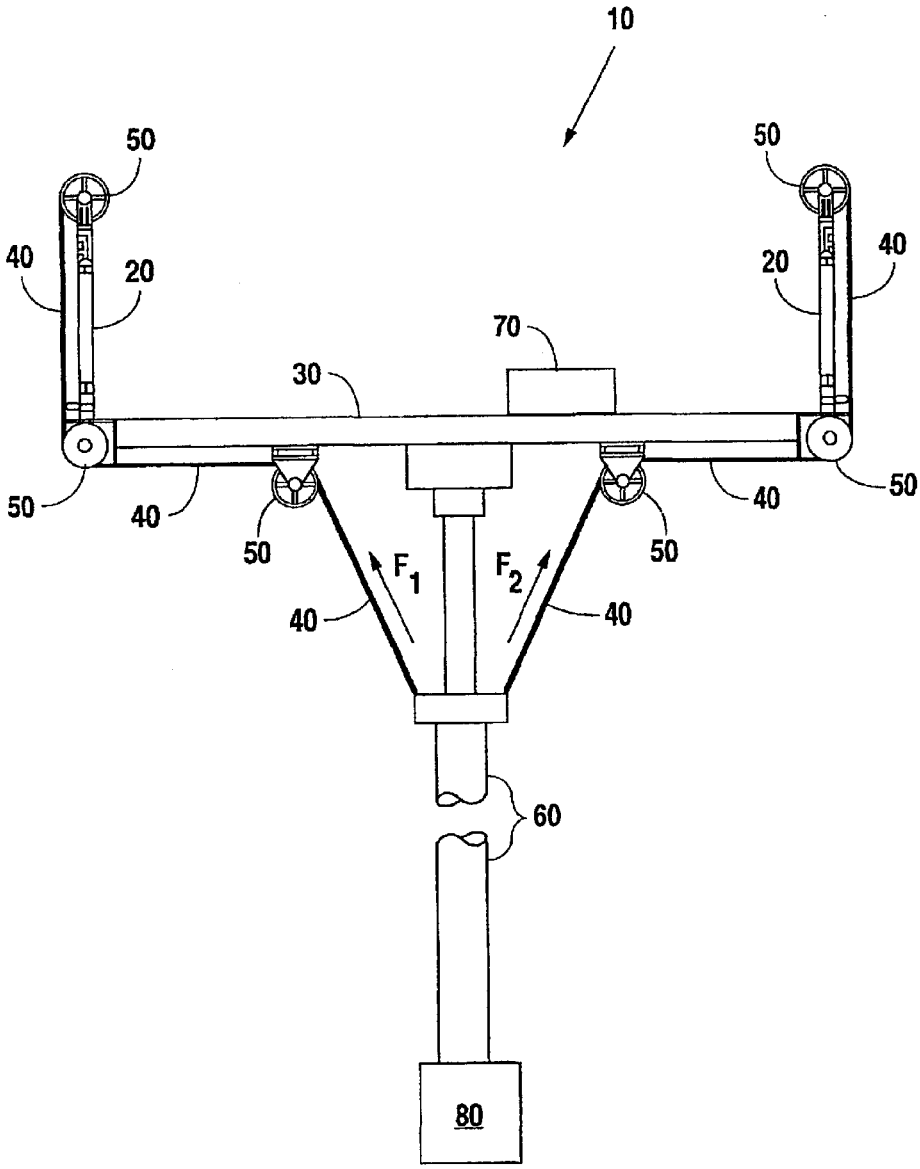
FIG. 1 is a planar side-view of the controller of the present invention mounted to a floating vessel from which a marine riser is suspended.

Referring now to FIG. 1, it can be seen that the invention includes a riser recoil control system (10) for adjusting a plurality of tension forces ($F_1$, $F_2$) applied to a marine riser (60) attached to a floating vessel (30). The riser (60) can be connected to, and disconnected from, a wellhead (80), and is attached to the vessel (30) using a plurality of riser tensioners (20) and tension forces ($F_1$, $F_2$) connected to the riser (60) with cables (40) and sheaves (50). The riser tensioners (20) are typically mounted (fixedly attached) to the floating offshore drilling vessel (30) (i.e., in mechanical communication with the vessel). The riser tensioners (20) may be equivalent to or identical to the actuating accumulator depicted in U.S. Pat. No. 5,209,302 (incorporated herein by reference in its entirety).

Figure 2:
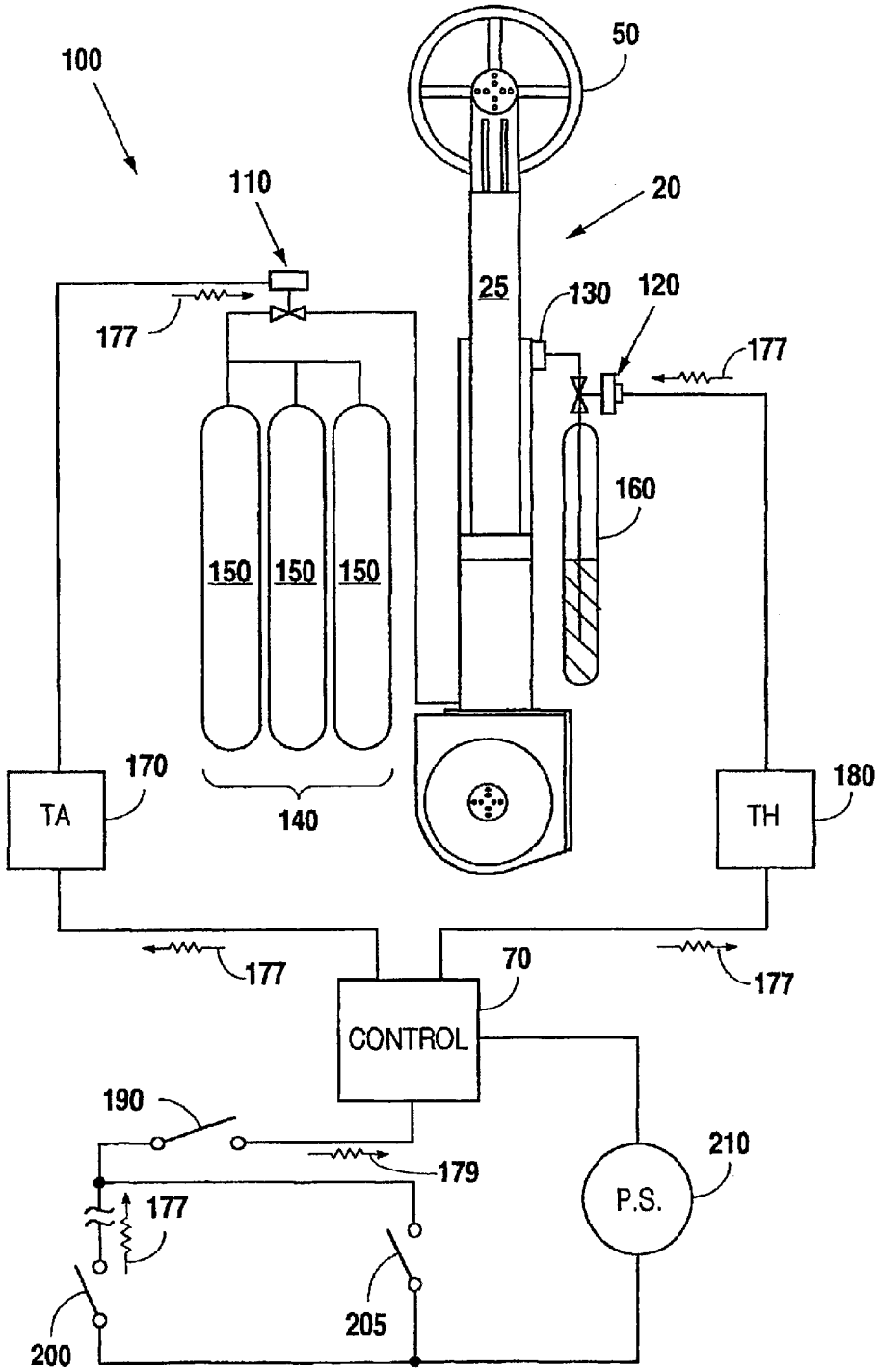
FIG. 2 is a schematic block diagram of the riser recoil control system of the present invention.

Turning now to FIG. 2, it can be seen that each tensioner (20) has an air shutoff valve (110), and an orifice-controlled fluid valve (120) set to a first preselected flow limit value (e.g. typically set to about 50% of the maximum free-flow rate value permitted by the fully-opened orifice-controlled fluid valve (120)). The air shutoff valve (110) may be equivalent to or identical to Retsco International, Inc. part #113045. The orifice-controlled fluid valve (120) may be equivalent to or identical to Retsco International, Inc. part #113001. Further, the riser tensioners (20) may include a fluid volume speed control valve (130) which acts to limit the volumetric rate of fluid flow in the riser tensioner upon sensing a predetermined volumetric rate of flow in excess of a predetermined critical volumetric rate of flow. The fluid may be air, oil, or other non-solid media used in tensioner piston assemblies. The fluid volume speed control valve (130) is equivalent to or identical to Retsco International, Inc. part #113102. The operational details of the speed control valve (130) are more fully described in U.S. patent application Ser. No. 09/733,227, incorporated herein by reference in its entirety.

There is also a disconnection sensing means (200), such as a switch (e.g., LMRP sensor), which is adapted to provide a disconnect signal when the riser (60) is disconnected from the wellhead (80). Application of the disconnect signal (directly or indirectly, via electronic or mechanical mechanisms well known in the art) to the air shutoff valves (110) and orifice-controlled fluid valves (120) of the tensioners (20) operates to close the valves (110, 120) and adjust the tension forces ($F_1$, $F_2$) applied to the marine riser (60) by the tensioners (20). Closing the air shutoff valves (110) and the orifice-controlled fluid valves (120) limits the rate of travel (i.e., velocity) experienced by the tensioner pistons (25) as the tension forces ($F_1$, $F_2$) on the riser (60) due to the wellhead (80) connection is reduced, and then eliminated, as the disconnect event progresses.

The orifice-controlled fluid valves (120) in the instant tensioner control system are preset to a particular preselected flow limit value before a riser (60) disconnect event occurs (i.e., before a disconnect signal is received). This "pre-disconnect" selected flow rate is set to be about 20% to about 95%, and most preferably to about 50% of the maximum flow rate value permitted by the fully-opened valve (120). When the disconnect signal is provided (i.e., when an unexpected riser disconnect occurs, or when the riser (60) is disconnected as a planned activity), the orifice-controlled fluid valve (120) is commanded to close to about 10% to 20%, and most preferably to about 15% of the maximum flow rate permitted by the fully-opened valve (120) (i.e., this is the "post-disconnect" preselected flow rate). The pre-disconnect, or first preselected flow rate is typically greater than the post-disconnect, or second preselected flow rate. Thus, while the air shutoff valve (110) is typically set to close completely upon sensing a disconnect event, the orifice-controlled fluid valve (120) is typically set to close down to about 15% of the maximum permitted flow value after disconnect, and takes about 0.5 seconds to close to this value from the 50% setting. The air shutoff valve (110) typically takes two or three seconds to close completely from a fully-open position.

The system (10) may include a (first) timer TA (170) adapted to delay closure of the air shutoff valves (110) for a preselected first delay time period after the disconnect signal is applied to the air shutoff valves (110). There may be another (second) timer TH (120) adapted to delay closure of the orifice-controlled fluid valves (120) for a different (second) preselected time period after the disconnect signal is applied to the orifice-controlled fluid valves (120). The first and second delay times may be selected to manage the "slingshot" effect of the disconnected riser (60) upon the vessel (30). In fact, it may be desirable to allow some portion of the tension forces ($F_1$, $F_2$) to remain so as to assist or "pull" the riser (60) up after the vessel (30), which prevents the riser (60) from hitting the wellhead (80) as the vessel (30) moves up and down. Such movement may occur, for example, if a fast-moving storm or gas bubble threatens to engulf the vessel (30) and rapid vessel (30) movement away from the wellhead (80) becomes a high priority.

The system (10) may also comprise a manual arming means (190), such as an emergency disconnect switch on the drilling rig BOP (Blowout Preventer) Control Panel, adapted to provide an arming signal upon activation by a human operator, wherein application of the arming signal sets up the system (10) to anticipate and act upon a disconnect signal initiated by the BOP stack plates as they separate (i.e., from the LMRP sensor (200)). The received LMRP (200) disconnect signal then operates to adjust the tension forces ($F_1$, $F_2$) applied to the marine riser (60) by closing the air shutoff valves (110) and orifice-controlled fluid valves (120) in the same fashion as would occur upon sensing an unexpected disconnect event at the wellhead. The first and second timers (TA, TH) for closing the air shutoff valves (110) and orifice-controlled fluid valves (120), respectively, may also be used to insert a time delay value into closure operations after a human operator activates the manual arming means (190) and a disconnect signal is sensed by the system (10). The arming means (190) may be a switch, conductivity sensor, current sensor, electromagnetic sensor, or any other device which provides an arming signal (179) to the system controller (70) indicating that riser disconnection is imminent. One example of such an arming means (190) is a barometer which senses an approaching hurricane via a large atmospheric pressure drop. Similarly, the disconnection sensing means (200) and/or the manual command disconnection means (205), may be a switch, conductivity sensor, current sensor, electromagnetic sensor, or any other device which provides a disconnect signal (177) to the controller (70) so as to indicate that a disconnect event has occurred.

The controller (70) may be a programmable logic controller, or computer, such as a personal computer, as is well known to those skilled in the art. Further, even though the manual arming means (190), disconnection sensing means (200), and manual command disconnection means (205) are shown as discrete switches, each of the elements (190, 200, 205) may also comprise a discrete, non-serial input into the controller (70). That is, each element (190, 200, 205) can provide a separate signal to the controller (70), which may use memory logic or software program logic modules to determine whether to apply the disconnect signal (177) to the valves (110, 120). A power supply (210) is typically used to supply power to the controller (70) and the arming means (190), disconnection sensing means (200), and manual command disconnection means (205).

The system (10) may be thought of as acting upon a two-stage trigger mechanism. Typically, an automated tension management system regulates the tension on the risers in response to vessel heave movement. The automated tension management system provides two signals to the manual riser recoil control system (10): the first is a command to anticipate disconnection of the riser (60) (which arms the manual system—stage one); the second is provided when the LMRP sensor (200) has confirmed disconnection/separation of the riser (60) (which activates the manual system—stage two).

Figure 3:
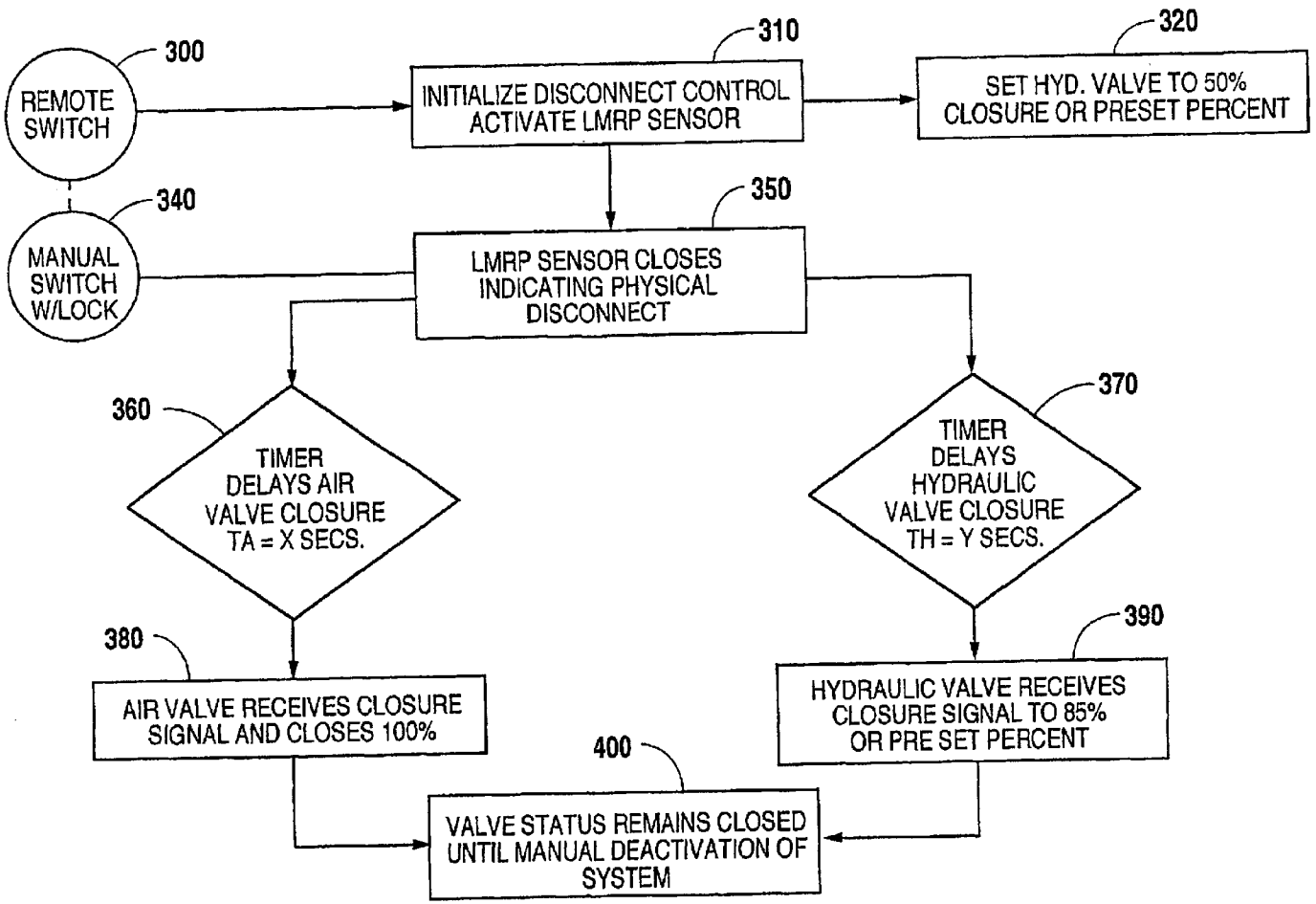
FIG. 3 is a flowchart diagram of the method of the present invention.

Turning now to FIG. 3, it can be seen that the invention also includes a method for adjusting the tension forces ($F_1$, $F_2$) applied to the riser (60) attached to the floating vessel (30) by a plurality of riser tensioners (20). Assuming that the riser tensioners (20) are fixedly attached or mounted to the vessel (30) and connected to the riser (60) via cables (40) and sheaves (50), that the tensioners (20) each have an air shutoff valve (110) and an orifice-controlled fluid valve (120) set to a first preselected flow limit value, and that there is a disconnection sensing means (200) adapted to provide a disconnect signal to the plurality of air shutoff valves (110) and orifice-controlled fluid valves (120) on the tensioners (20) when the riser (60) is disconnected from the wellhead (80) (or upon manual operator command, using a manual command disconnection means (205)), such as a switch (205), the method may comprise the steps of sensing the disconnect signal (177) provided by the disconnection sensing means (200) (or the manual command disconnection means (205)) in step (350) and adjusting the tension force applied to the riser (60) by closing the plurality of air shutoff valves (110) in step (380), and closing the orifice-controlled fluid valves (120) in step (390) so as to move them from a first "pre-disconnect" preselected value (of about 50% of maximum free-flow permitted by the valve) to a second "post-disconnect" preselected value (preferably about 15% of the maximum free-flow value). Steps (360) and (370) are optional steps which may be used to insert a time delay period between the time the disconnect signal (177) is applied to the air shutoff valves (110) and the orifice-controlled fluid valves (120), respectively, and the time the signal (177) is initially sensed or detected by the disconnection sensing means (200). The timers TA, TH can be left in the system (10) illustrated in FIG. 2, or the signal (177) may be applied directly to the valves (110, 120), bypassing the timers TA, TH entirely.

The step of adjusting the tension forces ($F_1$, $F_2$) applied to the riser (60) may be accomplished by applying the first (wellhead or BOP) disconnect signal (177) directly to the plurality of air shutoff valves (110) and orifice-controlled fluid valves (120) to enable their operation when a disconnect event is sensed by the LMRP (200). The method may include the steps of activating a manual arming means (190) so as to provide an arming signal (179) in steps (300, 340), which enables the system disconnection sensing means (200) to act upon sensing a disconnect signal (177), such that the system (10) operates to close down the orifice-controlled fluid valves (120) to a nominal value of about 50% (arming prior to activation) of its fully-opened value in steps (310, 320); and adjusting the tension forces ($F_1$, $F_2$) applied to the riser (60) by applying the disconnect signal (177) (after it is received) directly to the plurality of air shutoff valves (110) and orifice-controlled fluid valves (120) so as to close the plurality of air shutoff valves (110) and orifice-controlled fluid valves (120) in steps (380, 390), as described previously. Finally, the method may include the steps of individually adjusting the timing of the closures for the air shutoff and/or orifice-controlled fluid valves (110, 120) to manage the rate of tension application by the tensioners (20) to the riser (60) in steps (360, 370), as described above. The arming signal may be implemented such that sensing the disconnect signal is disabled until after the arming signal has been received by the system. As shown in FIG. 2, this may be accomplished by placing the arming means (190) and disconnection sensing means (200) in series with each other. Of course, as is well known to those skilled in the art, the arming means (190) and disconnection sensing means (200) can also provide discrete, non-serial logic signals to the controller (70), if desired.

The method ends at step (400), wherein the valves (110, 120) remain closed until the system is manually deactivated. This may occur, for example, by opening the manual command means (205), which may signal the controller (70) to reset an/or open the values (110, 120).

Although preferred embodiments of the method and apparatus of the present invention have been illustrated in the accompanying Drawings and described in the foregoing Detailed Description, it will be understood that the invention is not limited to the embodiments disclosed, but is capable to numerous rearrangements, modifications and substitution without departing from the scope of the invention as set forth and defined by the following claims.

What is claimed is:

1. A riser recoil system for adjusting a plurality of tension forces applied to a riser conductor attached to a floating vessel, wherein the riser is adapted to be connected to and disconnected from a wellhead, comprising:

a plurality of riser tensioners in mechanical communication with the vessel and the riser, each one of said plurality of riser tensioners having an air shutoff valve and an orifice-controlled fluid valve set to a first preselected flow limit value; and a disconnection sensing means adapted to provide a disconnect signal when the riser is disconnected from the wellhead, wherein application of the disconnect signal to the plurality of air shutoff valves and orifice-controlled fluid valves operates to adjust the plurality of tension forces applied to the marine riser by closing the plurality of air shutoff valves and closing the plurality of orifice-controlled fluid valves to a second preselected nonzero flow limit value, and wherein the first preselected flow limit value is greater than the second preselected nonzero flow limit value.

2. The system of claim 1, wherein the first preselected flow limit value is about 50% of a maximum free-flow value permitted by the orifice-controlled fluid valve, and wherein the second preselected nonzero flow limit value is about 15% of the maximum free-flow value permitted by the orifice-controlled fluid valve.

3. The system of claim 1, wherein each one of the riser tensioners includes a fluid volume speed control valve which acts to limit the volumetric rate of fluid flow in the riser tensioner upon sensing a predetermined volumetric rate of flow in excess of a predetermined critical volumetric rate of flow.

4. The system of claim 1, further comprising a first timer adapted to delay closure of the plurality of air shutoff valves for a preselected first delay time period after the disconnect signal is sensed by the disconnection sensing means.

5. The system of claim 1, further comprising a second timer adapted to delay closure of the plurality of orifice-controlled fluid valves for a second preselected time period after the disconnect signal is sensed by the disconnection sensing means.

6. The system of claim 1, further comprising a manual arming means adapted to provide an arming signal upon activation by a human operator, wherein application of the arming signal enables sensing the disconnect signal.

7. The system of claim 6, further comprising a first timer adapted to delay closure of the plurality of air shutoff valves for a preselected first delay time period after the disconnect signal is sensed by the disconnection sensing means.

8. The system of claim 6, further comprising a second timer adapted to delay closure of the plurality of orifice-controlled fluid valves for a preselected second delay time period after the disconnect signal is sensed by the disconnection sensing means.

9. A method for adjusting a plurality of tension forces applied to a marine riser attached to a floating vessel by a plurality of riser tensioners in mechanical communication with the vessel and the riser, each one of the plurality of riser tensioners having an air shutoff valve and an orifice-controlled fluid valve set to a first preselected flow limit value, wherein the riser is adapted to be connected to and disconnected from a wellhead, and wherein a disconnection sensing means is adapted to provide a disconnect signal to the plurality of air shutoff valves and orifice-controlled fluid valves when the riser is disconnected from the wellhead, comprising the steps of:

sensing the disconnect signal provided by the disconnection sensing means; and adjusting the plurality of tension forces applied to the riser after the step of sensing the disconnect signal by closing the plurality of air shutoff valves and closing the plurality of orifice-controlled fluid valves to a second preselected nonzero flow limit value, wherein the first preselected flow limit value is greater that the second preselected nonzero flow limit value.

10. The method of claim 9, wherein the step of adjusting the plurality of tension forces applied to the riser is accomplished by applying the disconnect signal directly to the plurality of air shutoff valves and orifice-controlled fluid valves.

11. The method of claim 9, further comprising the steps of:

activating a manual arming means so as to provide an arming signal; and adjusting the plurality of tension forces applied to the riser by sensing the disconnect signal after activating the manual arming means.

12. The method of claim 9, wherein the first pre-selected flow limit value for the plurality of orifice-controlled fluid valves is about 50% of a maximum permitted free-flow value, and wherein the second pre-selected nonzero flow limit value for the plurality of orifice-controlled fluid valves is about 15% of the maximum permitted free-flow value.

* * * * *